United States Patent [19]

Prochnow

[11] Patent Number: 4,470,358

[45] Date of Patent: Sep. 11, 1984

[54] CONTINUOUS SOLID FUEL-BED DEGASIFICATION BURNER APPARATUS

[76] Inventor: Karl-Wilhelm Prochnow, D 5063 Overath-Untereschbach, POB 5166, Fed. Rep. of Germany

[21] Appl. No.: 456,280

[22] Filed: Jan. 6, 1983

[30] Foreign Application Priority Data

Jan. 7, 1982 [EP] European Pat. Off. ..... 82100067

[51] Int. Cl.[3] ..... F23G 5/00

[52] U.S. Cl. ..... 110/229; 110/206; 110/254; 110/255; 110/303

[58] Field of Search ..... 110/229, 231, 248, 254, 110/255, 302, 303, 102, 205, 206

[56] References Cited

U.S. PATENT DOCUMENTS

| | | | |
|---|---|---|---|
| 2,284,506 | 5/1942 | Zuberbuhler | 110/303 |
| 2,592,730 | 4/1952 | Perkins | 110/229 |
| 3,915,104 | 10/1975 | Hapgood | 110/255 X |
| 4,037,543 | 6/1977 | Angelo | 110/254 X |
| 4,335,660 | 6/1982 | Maloney | 110/206 |
| 4,361,100 | 11/1982 | Hinger | 110/229 X |
| 4,377,116 | 3/1983 | Satake | 110/229 X |
| 4,402,273 | 9/1983 | Nagl | 110/229 |

*Primary Examiner*—Henry C. Yuen

*Attorney, Agent, or Firm*—Wood, Dalton, Phillips, Mason & Rowe

[57] ABSTRACT

In a combustion chamber (20) the biomass to be degasified is placed via a conveyor screw (11) on to a trough (24). In the degasification chamber (20) there prevails a high temperature due to the vicinity of the flame chamber (27), so that the biomass is being degasified. The escaping gasses are burned in the flame chamber (27). Between the wall of the degasification chamber (20) and an outer casing (28) there is an air chamber (29) in which the fresh air introduced from the outside is preheated and thereafter is guided partly through the trough (24) and partly to another section of the flame chamber (27).

5 Claims, 8 Drawing Figures

Figure 1:
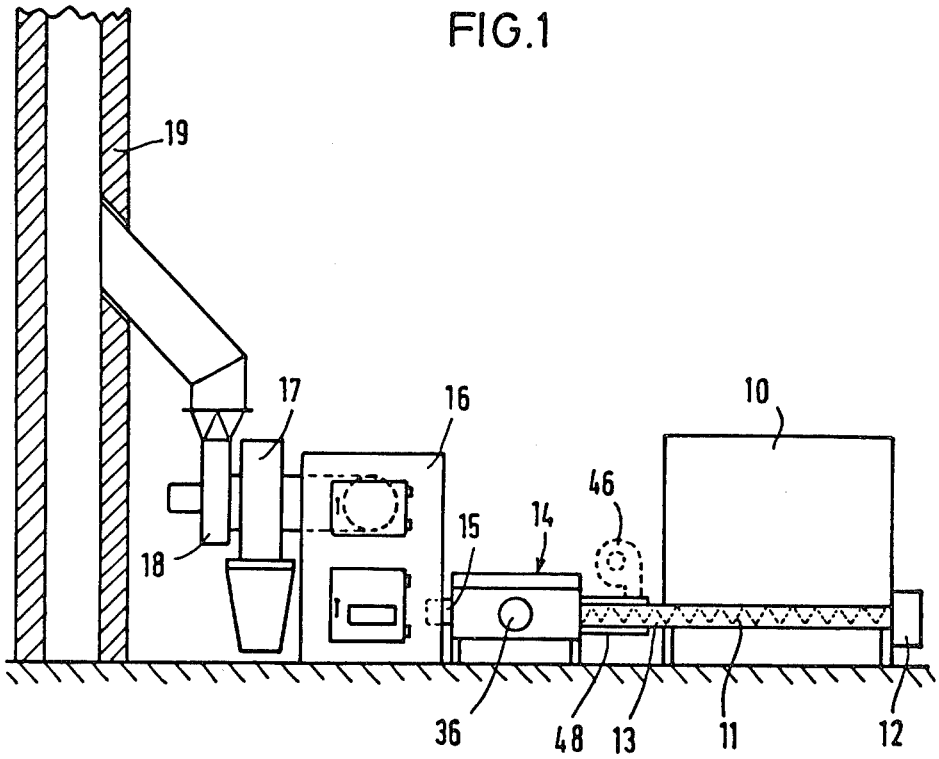

FIG.6
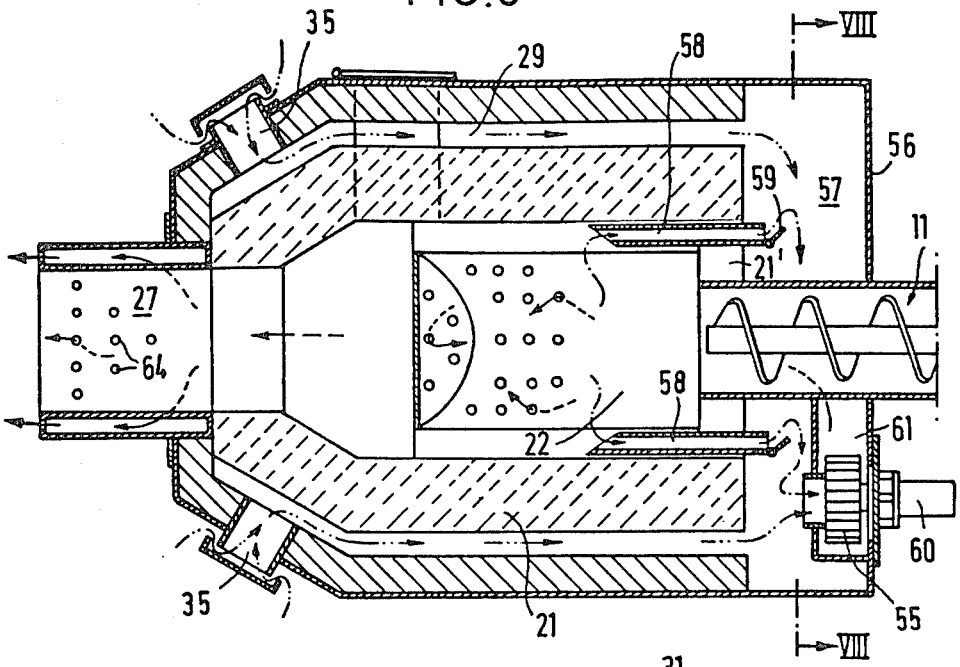
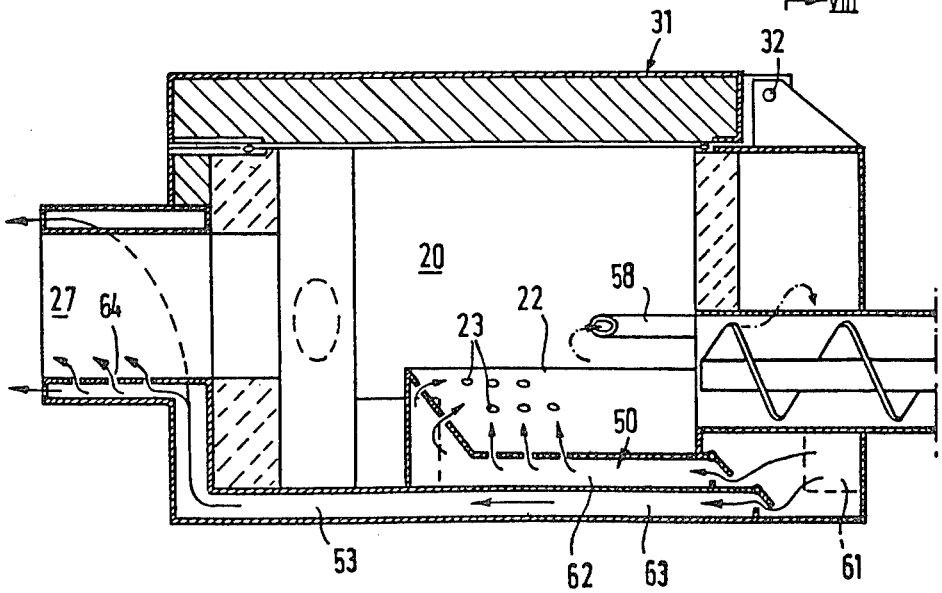
FIG.7

CONTINUOUS SOLID FUEL-BED DEGASIFICATION BURNER APPARATUS

This invention deals with an apparatus for solid-fuel bed degasification from biomasses in heating installations with a degassing chamber into which leads a conveyor device conducting the biomass and consisting at least partly of a refractory lining, with a flame chamber emerging from the degassing chamber and with at least one blower conveying air into the degassing chamber.

Biomasses being used for heating purposes are for example wood, straw, peat and other solid fuels containing carbon.

Such materials are chopped in case they are not already available in free-flowing consistency. For example copswood, woodwaste or similar material picked up in the woods can be shredded to whittling and thereafter be used for heating.

Also coffeepeals, coffeegrounds, peanutshells and similars can be used for heating purposes. Such materials which will be generally defined here as "Biomass" contain as a rule much moisture and impuraties for example dust. A direct combustion of the biomass results only in low energy yield particularly due to moisture contents.

The solidfuel-bed degasification for heat production out of biomass is already known. In this process biomass is continuiously conveyed to a degasification chamber, in which a high temperature prevails. In the degasification chamber the combustible gasses escape out of the biomass. Through appropriate guidance of air flow these gasses are conducted into a flame chamber where they are burned under supply of fresh air. The resulting heat is also used for heating the degasification chamber. As the interior of the degasification chamber has to be maintained at a high temperature, this also results in a strong heating-up of the walls of the degasification chamber. The external wall of the degasification chamber adopts high temperature values even in case of an additional thermic insulation so that injuries to persons can occur by touch. On the other hand a lot of heat loss is radiated by the degasification chamber.

The basic aim of this invention is to continue developing a device of the kind mentioned above, with a view to improve exploitation of heating energy contained in the biomass, to improve combustion and to design the degasification chamber in such a way that no danger of burns occur to people touching the device.

To solve this problem it is contemplated within the invention that at least one wall of the degasification chamber should comprise, between the inner lining and an exterior wall an air chamber receiving air from an outside air blower and positioned upstream of the degasification chamber.

By this arrangement, the air conveyed to the degasification chamber is guided primarily along a wall of the degasification chamber. This wall and the outer one are cooled by this air.

By the heating-up of the air the air conveyed to the degasification chamber is already preheated, so that degasification is accelerated. The preheating of the air thus bears the advantage of cooling the wall and accelerating the degasification process.

In order to achieve a favourable development of the invention the air chamber has at least one outlet leading into that section of the flame chamber directed towards the degasification chamber. Through this outlet, the section of which is preferably adjustable, combustion air is conveyed to the flame chamber which also has been preheated in the described way, whereby the combustion temperature of the gasses is increased.

The flame chamber suitably consists of a tube immediately adjacent to the degasification chamber and leading into a boiler. Thus combustion not only takes place in the boiler but also in the tube in front of the boiler. By the airflow conduction the combustion gasses flow into the boiler and there they warm up the water flowing through the pipe coils of a heat exchanger for example.

Temperature regulation can be effected on one hand by variation of the air volume conveyed to the ignition chamber and on the other hand by changing the air volume conveyed to the degasification chamber.

According to a first model of the invention it is foreseen that the blower is placed at an air inlet of the airchamber and sucks air from the environment, and that cut of the airchamber a first outlet near the conveyor, leads into the degasification chamber and a second outlet leads into the flame chamber.

The air inlet is preferably placed approximately in the middle of the longitudinal extension of the degasification chamber with the result that two airstreams are produced in the airchamber of which one flows towards the inlet of the material to be degassed and the other flows towards the flame chamber. Thus an even airing of the degasification chamber in its full length is assured. Fresh air is conveyed to the airchamber by pressure of the blower so that a pressure higher than the atmospheric pressure prevails in the air chamber.

In a second model of the invention the blower is placed in the airstream path behind the airchamber and in front of the degasification chamber. Between the blower and the degasification chamber an air channel is placed in heat exchange with the conveyor.

There is a danger that the conveyor leading into the very hot degasification chamber is heated up to a high degree, so that the biomass contained in it is set aflame. On the other hand as a rule the conveyor is also sensitive to strong thermic load. If the trough of the conveyor device is exposed to high defferences in temperature, it can damage the adjoining lining of the degasification chamber by the movements caused thermically. By cooling the conveyor as described above its temperature is limited thus avoiding the above mentioned disadvantages.

In the context of this invention it also is possible to conduct nonpreheated fresh air along the wall of the conveyor, in order to lead this air subsequently to the degasification chamber respectively the flame chamber. Thereby cooling of the conveyor is even being improved compared to the cooling with preheated air.

The degasification chamber preferably comprises a trough into which the conveyor transparts biomass, whereby the airflow is directed from below through openings in the basin.

As a conveyor a screw conveyor is preferably used. At the unloading end of the screw conveyor shaft, according to a favoured design of the invention, a bladebeater is attached, which revolves in a trough receiving the biomass. The bladebeater, which for example can be equipped with wings like a screw-propeller, effects a constant agitation of at least part of the biomass contained in the trough, thereby preventing individual parts of the biomass settling on the ground of the trough over a longer period of time.

In addition a loosening of the biomass conveyed to the trough is achieved. This results in a homogeneous and more intensive degasification.

There exists the possibility that in the degasification chamber, in which the water, contained in the biomass, evaporates and in which subsequently the degasification is performed, during which carbonizing gasses containing carbon are escaping from the biomass, a fuel mixture may be produced which will burn only incompletely in this combustion chamber under intensive smoke production.

In order to improve the combustion of the carbonizing gas it is foreseen, according to a favoured design of the invention that at least one exhaust channel exposed to the sucking effect of the blower leads out of the degasification chamber and that the extracted carbonizing gas is guided by the blower to the flame chamber and/or the degasification chamber after being mixed with fresh air.

Surprisingly it turned out that it is possible to achieve a combustion with considerably less residue if a part of the carbonizing gasses is extracted from the degasification chamber, mixed with fresh air and thereafter conducted into the flame chamber and/or degasification chamber. Hereby a still better mixing of decarbonizing gasses with fresh air is obtained. Experiments have shown that this carbonizing gas/fresh air mixture burns with white respectively colourless flame leaving very little residue, thus obtaining a very good heat efficiency.

According to a favoured design of the invention at a front end of the degasification chamber there is a suction chamber adjoining the blower, which is connected to the air chamber and to the suction channel. The outlet of the blower is conveyed through two defferent channels, one of which leads below the biomass into the degasification chamber and the other leads into the flame chamber. The carbonizing gas/fresh air mixture is herewith divided into a first portion being conveyed to the degasification chamber and a second portion being conveyed to the flame chamber.

The fact that in the suction chamber of the blower the carbonizing gas is mixed with preheated fresh air is particularly advantageous. Thereby it is avoided that steam contained in carbonizing gas condensates and that water and solid sediments are generated.

In the following with reference to the figures some examples of arrangement are more closely explained:

FIG. 1: schematic exhibit of the entire apparatus

Figure 2:
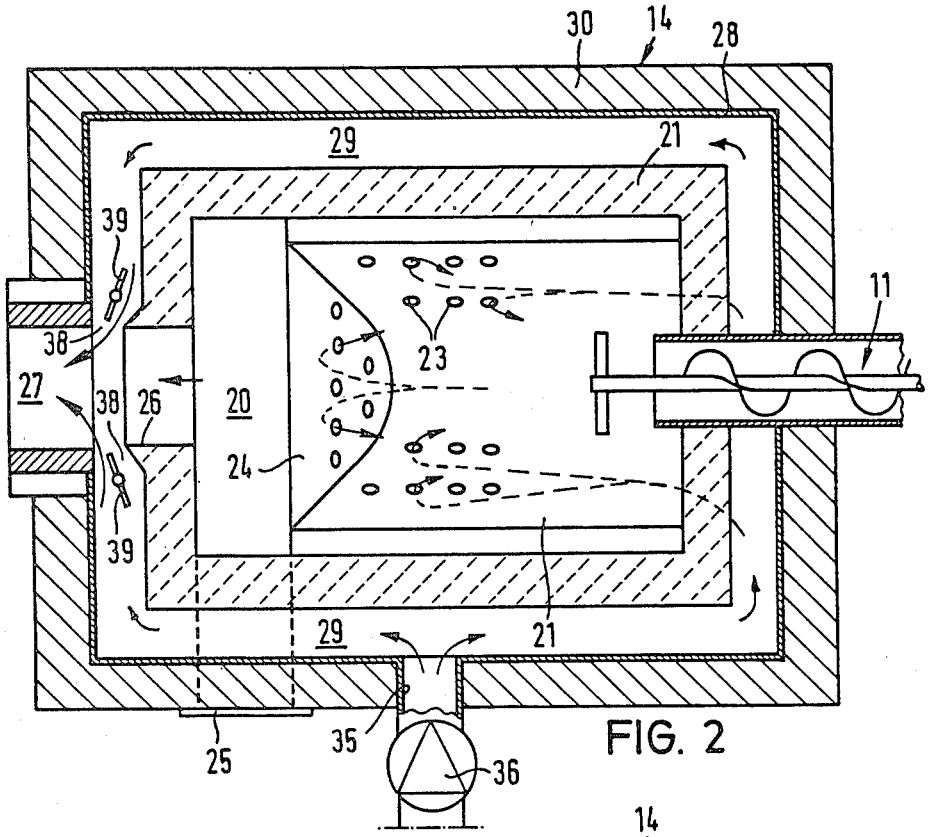

FIG. 2: horizontal longitudinal section through a first design of the degasification and combustion apparatus.

Figure 3:
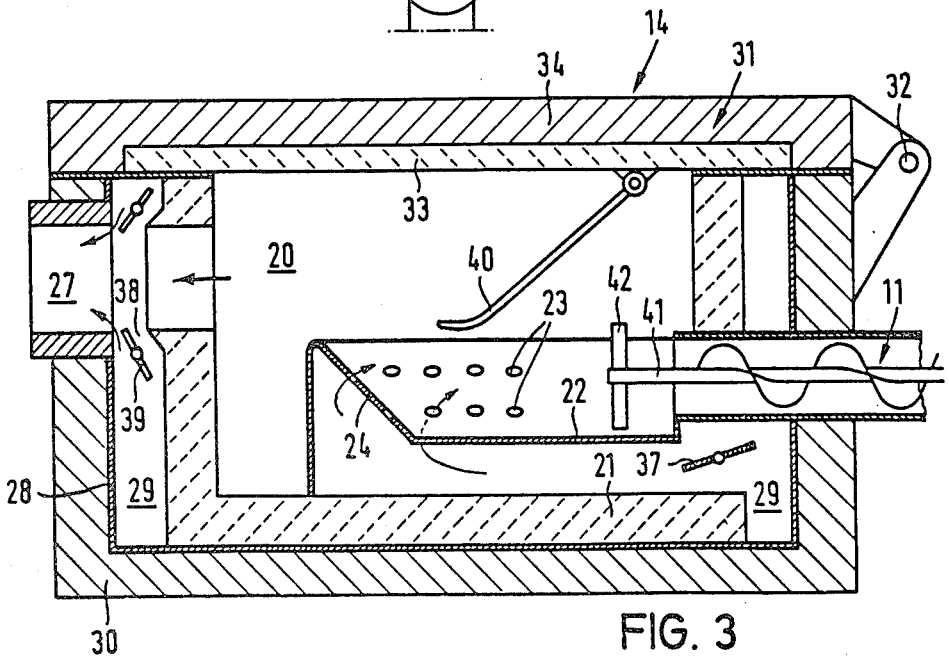

FIG. 3: a vertical longitudinal section through the device according to FIG. 2.

Figure 4:
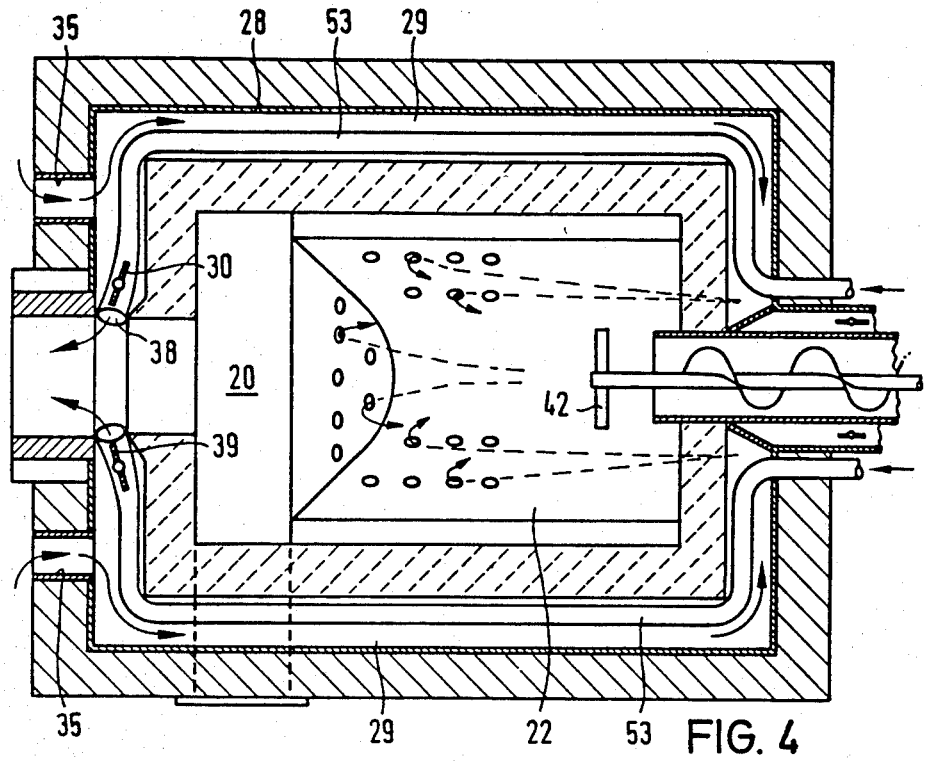

FIG. 4: a horizontal longitudinal section through a second variant of the degasification and combustion device.

Figure 5:
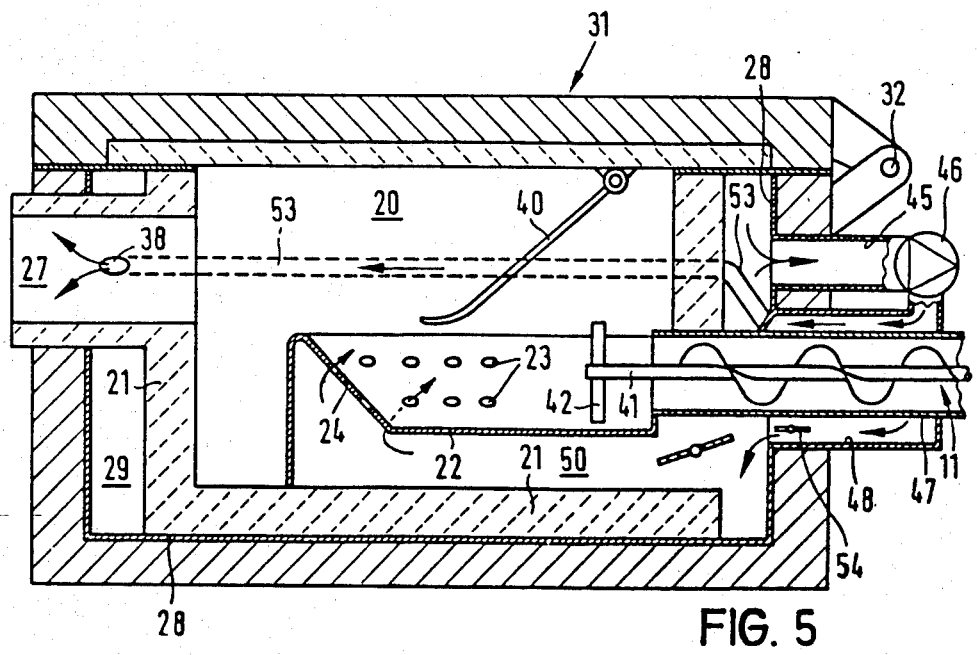

FIG. 5: a vertical longitudinal section of the device according to FIG. 4

Figure 8:
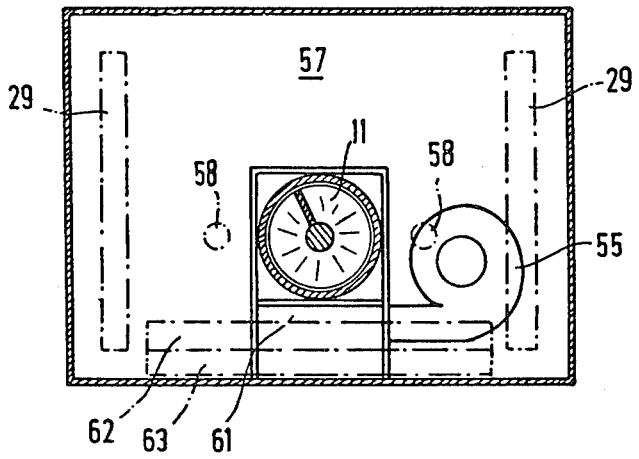

FIG. 6: a horizontal section through a third variant of the degasification and combustion device FIG. 7: a vertical longitudinal section of the device of FIG. 6 and FIG. 8: a section along line VIII—VIII According to FIG. 1 a fuel storage bin 10 is considered which contains the biomass e.g. chips of wood. Above the bottom of the bin there is a channel containing a screw conveyor 11. The mainly horizontal screw conveyor 11 which is driven at its rear end by a motor 12, leads out of the storage bin 10 through a conveyor channel 13 and is supplying continuously the fuel to the degasification apparatus 14. At the end of the degasification device 14 opposite to the screw conveyor there is the flame chamber 15, in which the gasses produced by the fuel are burned.

The flame chamber 15 leads into a boiler 16, which contains a heat exchanger, in order to transfer the heat of the combustion gas to a water circuit, for example. The boiler 16 is connected to a dust collector 17, which conveys the flue gas via an exhaust blower 18 to a chimney 19.

According to FIGS. 2 and 3 the degasification device 14 displays a degasification chamber 20, the walls 21 of which consist of a fire-proof material e.g. fire-clay. The degasification chamber 20 is in the present case square shaped, i.e. rectangular. It contains a trough 22 made of heat-resistant steel. The bottom of the trough shows aperture 23 for the penetration of air.

The screw of the screw conveyor 11 projects through an aperture in a front wall of the degasification chamber and ends above the trough 22, so that the fuel transported by the screw conveyor falls into the trough 22 and there is being pushed forward by the subsequent fuel. The limiting wall 24 of the trough 22 situated opposite to the screw conveyor 11 is oblique. Due to the high temperature existing in the degasification chamber 20 the fuel is being degasified. The residues remaining in the trough are pushed up the sloped front wall by the subsequent fuel and fall after having passed the front edge of the trough into a pit, which is accessible via a cover 25 in order to be able to remove the ashes.

The front wall of the degasification chamber 20 opposite to the screw conveyor 11 shows an aperture 26 which constitutes the rear end of the flame channel 27.

The flame channel 27 is mainly pipe shaped and stands out in a right angle to the front wall of the degasification chamber 20. Its wall is also lined with fire-proof material.

The side-walls 21 of the degasification chamber 20 consisting of fire-proof material are surrounded by a casing 28 of heat-resistant steel, whereby between the side walls 21 which comprise the front walls, the air chamber 29 is situated. In this way the airchamber 29 surrounds the wall 21 of the degassing chamber 20 completely - in plan-view -. However, according to FIG. 3 the bottom wall of the chamber 20 lies immediately on top of the bottom of the casing 28. The external side of the casing 28 is provided with a heat insulating lining 30.

The degasification chamber 20 and casing 28 are box-shaped containers, the top edges of which are situated on a common level and closed by a cover 31. The cover 31 is linked via a joint 32 to the rear front wall of the degassing device, so that it can be swung up. The lower side of cover 31 is provided with at fire-proof coating 33 over which a layer of insulating material is placed.

In the middle of the length of a side wall of casing 28 there exists an air inlet 35, through which outside air is forced into the air chamber 29 by means of a blower 36. A part of this air flows into the air chamber 29 towards each the conveyor device 11 and the flame channel 27.

In the rear wall of the degasification chamber 20 and underneath the conveyor device 11 there exist apertures, the opening diameter of which is adjustable by regulating elements 37.

Through these apertures the air which has been preheated in the air-channel 29 enters the area of the degasification chamber 20 located underneath the trough 22. From there the air flows in direction of the depicted arrows through the holes 23 and through the fuel contained in trough 22. The other airstream in the air chamber 29 flows to the outlet apertures 38 leading into the flame chamber 27, the opening diameter of which can also be adjusted by regulating element 39.

Above the trough 22 fitted to the cover 31 through an articulation there exists a sensing bar 40, which lies obliquely from above on the fuel contained in the trough 22. This sensing bar 40 operates a switch (not depicted in the figures) whenever the volume of the fuel becomes too great. The switch controls the conveyor device 11, which thereby switches off automatically in the event of material overflow.

The front end of the shaft 41 of the screw conveyor 11 is prolongued beyond the conveyor screw. At this end there exists a blade beater 42 rotating with the shaft 41 in the trough 22. This blade beater serves the purpose of keeping in constant movement the fuel contained in the trough 22 and contributes to the loosening and thereby to a better degassing of the fuel.

In the example of FIGS. 4 and 5 those parts which have the identical function in both examples are marked with the same reference identifications as in the examples of FIGS. 1 and 2. The following illustration limits itself to those features which differ from the exemplification of FIGS. 4 and 5 to the previous example.

In the model of FIGS. 4 and 5 the air chamber 29 shows several inlet apertures 35 in the rear wall of casing 28. Through these inlet openings 35 the air is sucked through air chamber 29, in order to be sucked into a channel 45 parting from the front wall of casing 28. The air flow is effected by the blower which is connected with its sucking inlet to channel 45. The pressure outlet of the blower 46 is connected to an air channel 48 which coaxially surrounds the pipe-shaped wall 47 of the screw conveyor. The air channel 48 is connected on one hand with space 50 underneath the trough 22 and on the other hand via pipelines 53 with the outlet apertures 38 leading into the flame channel 27. The pipelines 53 lead according to FIG. 4 through the air chamber 29. The air-outlets 38 are adjustable in their section by regulating elements 39. In the same way the amount of air flowing into the space 50 can be adjusted by regulating element 54. The air in space 50 can only flow into the other part of the degasification chamber 20 through apertures 23. So the space 50 is completely sealed at its sides by the walls of the trough 22.

In this model the blower 46 sucks outside air from the inlet apertures 35 through air chamber 29 and channel 45. This air is distributed in adjustable quantities under overpressure among space 50 of the degasification chamber 20 and the flame chamber 27. The special advantage lies in the fact that wall 47 of the screw conveyor 11 is kept at a substancial constant temperature level by the air flowing around it, so that overheating of this wall 47 does not occur.

At the same time, the formation of cracks is avoided at the point of contact of the wall 47 with the material of the fireproof lining.

In the schematic drawing of FIG. 1 both kinds of airflow previously described are indicated. Here the blower 36 is drawn with full lines in the arrangement represented in FIGS. 1 and 2, whereas the blower 46 is drawn with dotted lines in the arrangement represented in FIGS. 4 and 5.

In the example of FIGS. 6 to 8 the screw conveyor 11 also conveys biomass onto the perforated trough 22 which is situated in the degassing chamber 20. Between the fire-proof rear wall 21 and the outer case 56 there exists a suction chamber 57 in which underpressure is produced by the blower 55. The lateral air chambers 29 lead into the suction chamber 57, which are in connection with the air inlets 35 and which are limited by the lateral walls 21 of the degasification chamber 20.

Out of the degasification chamber 20 exhaust channels 58 lead into the suction chamber 57. The exhaust channels 58 are pipes which end laterally above the perforated bottom of the trough 22 and which suck off part of the carbonizing gas escaping from the biomass. At the ends of the exhaust channels 58 there are placed adjustable flaps 59 in order to be able to change the carbonizing gas suction.

The blower 55 the suction opening of which is placed in suction chamber 57, is driven by a motor 60. On one hand it sucks carbonizing gas via the exhaust channel 58 and on the other hand preheated fresh air via the air chambers 29. This carbonizing gas/fresh air - mixture is conveyed by the blower 55 into a distributing box 61 the outlet of which is linked with a first channel 62 and a second channel 63. The first channel leads into the space 50, which is placed under the trough and is limited by sidewalls. From this space 50 carbonizing gas/-fresh air - mixture ascends through the apertures 23. The second channel 63 leads along the degasification chamber 20 to the flame chamber 27. The flame chamber 27 has been designed double-walled. The inner wall shows outlet apertures 64 for the carbonizing gas/fresh air - mixture.

In FIGS. 6 and 7 the gas streams are indicated. The fresh air which flows through the lateral air chambers 29, is indicated by a line consisting of two dots and a dash. The flow of the carbonizing gas which is sucked out of degasification chamber 20, is drawn dashdotted and the carbonizing gas/fresh air-mixture flowing out of the distribution chamber 61 is indicated with a through line.

As can be seen from FIG. 8 the air chambers 29 run parallel to the sidewalls 21 of the degasification chamber 20. The blower 55 is placed beside the conveyor screw 11 and it blows into the distribution chamber 61, placed beneath the conveyor screw 11. The distribution chamber 61 is in connection with both channels 62 and 63 which run one on top of the other along the bottom wall.

I claim:

1. Apparatus for solid fuel bed degasification of biomass in heating installations comprising, a degasification chamber having side walls and opposed end walls with an inlet in one end wall and a gas outlet in the other end wall, a perforated trough in said degasification chamber and spaced from the bottom thereof to define an air space therebetween, an air inlet to said air space, a conveyor extending into said degasification chamber for conveying biomass to the trough and advancing biomass in the trough, a flame chamber having an inlet connected to said gas outlet of the degasification chamber, a casing surrounding said degasification chamber and having side walls spaced from the side walls of the degasification chamber to define air chambers therebetween, said air chambers communicating with the flame chamber inlet and with said inlet to the air space beneath the trough, and said air chambers having at least one connection to an outside air supply located to have outside air flow along at least approximately one-half of said air chambers counter to the direction of flow of biomass in the trough to said inlet to the air space beneath the trough.

2. Apparatus as defined in claim 1 wherein there are a pair of connections to outside air supply located adjacent an end of the casing remote from said conveyor.

3. Apparatus as defined in claim 1 including a blower having an inlet communicating with said air chambers and an outlet communicating with said inlet to the air space beneath the trough.

4. Apparatus as defined in claim 3 wherein said conveyor has a surrounding tubular wall and outside air as drawn from said air chambers by said blower is caused to flow around said tubular wall.

5. Apparatus for solid fuel bed degasification of biomass in heating installations comprising, a degasification chamber having side walls and opposed end walls with an inlet in one end wall and a gas outlet in the other end wall, a perforated trough in said degasification chamber and spaced from the bottom thereof to define an air space therebetween, an air inlet to said air space, a conveyor extending into said degasification chamber for conveying biomass to the trough and advancing biomass in the trough, a flame chamber having an inlet connected to said gas outlet of the degasification chamber, a casing surrounding said degasification chamber and having side walls spaced from the side walls of the degasification chamber to define air chambers therebetween, said air chambers having connections to an outside air supply located to have outside air flow along a major part of the length of said air chambers counter to the direction of flow of biomass in the trough, a suction chamber at one end of the casing and communicating with said air chambers, exhaust channels extending from the degasification chamber at a level above said trough and communicating with said suction chamber, a blower having an inlet connected to said suction chamber, air passage means extended from the blower outlet to said flame chamber inlet, and air passage means extended from the blower outlet to the inlet to said air space beneath the trough.

* * * * *